United States Patent [19]

Asai et al.

[11] Patent Number: 4,935,165

[45] Date of Patent: Jun. 19, 1990

[54] METHOD FOR PREVENTING THE POOR CONDUCTION AT ELECTRICAL SWITCH CONTACTS WHICH IS CAUSED BY ORGANOPOLYSILOXANE GAS

[75] Inventors: Hiroyuki Asai; Katsutoshi Mine; Hiroshi Matsuoka, all of Ichihara, Japan

[73] Assignee: Toray Silicone Company, Ltd., Tokyo, Japan

[21] Appl. No.: 115,462

[22] Filed: Oct. 30, 1987

[30] Foreign Application Priority Data

Oct. 31, 1986 [JP] Japan ..... 61-261345

[51] Int. Cl.[5] ..... H01B 3/56

[52] U.S. Cl. ..... 252/571; 174/17 GF; 174/17 LF; 174/17 SF; 174/52.2; 200/149 A; 200/150 A; 200/151; 252/573; 252/575; 361/319; 361/323; 524/251; 524/252; 524/257; 528/901

[58] Field of Search ..... 174/17 GF, 17 LF, 17 SF, 174/52.2; 200/149 A, 150 A, 151; 252/571, 573, 575; 361/319, 323; 524/251, 252, 257; 528/901

[56] References Cited

U.S. PATENT DOCUMENTS 2,377,689 6/1945 Hyde ..... 200/150 A
2,389,802 11/1945 McGregor et al. ..... 252/573

*Primary Examiner*—Robert A. Wax
*Attorney, Agent, or Firm*—Roger H. Borrousch

[57] ABSTRACT

The poor electrical conduction at an electrical switch contact caused by organopolysiloxane gas can be prevented by providing that a nitrogenous base gas be simultaneously present with the organopolysiloxane gas. Nitrogeneous base gases can be aliphatic amines or aromatic amines.

8 Claims, No Drawings

METHOD FOR PREVENTING THE POOR CONDUCTION AT ELECTRICAL SWITCH CONTACTS WHICH IS CAUSED BY ORGANOPOLYSILOXANE GAS

BACKGROUND OF THE INVENTION

1. Field of the Invention

The present invention relates to a method for preventing the poor conduction at electrical switch contacts which is caused by organopolysiloxane gas.

1. Prior Art

Silicone products which are principally composed of organopolysiloxane have an excellent heat resistance, cold resistance, and chemical resistance, as well as excellent electrical insulating properties, and accordingly are used in numerous electrical devices as an insulating material, for example, as heat-resistant electric wire packing, grease, etc. However, these silicone products have an adverse effect on electrical switch contacts which may be used in the vicinity and frequently cause the problem of a defective electrical contact, that is the problem of poor conduction It has been reported that low molecular weight organopolysiloxanes remaining in the silicone product evaporate at room temperature or under heating, and that this gas reaches the electrical switch contact and is subjected to the discharge energy from the opening and closing of the contact. As a result, it undergoes a chemical conversion, and forms an insulating substance such as silicon dioxide, silicon carbide, etc. (refer, for example, to Denki Tsushin Gakkai Gijutsu Kenkyu Hokoku, 76 (226). pages 29 to 38, (1977) [Institute of Electronics and Communication Engineers of Japan, Technical Research Reports, 76 (226). pages 29 to 38 (1977)]. However, when one considers methods for preventing the poor conduction at electrical switch contacts which is caused by this low molecular weight organopolysiloxane gas, one finds that no truly excellent means for solving this problem has been found. Proposed methods have been no better than a method in which the low molecular weight organopolysiloxane is removed by a thermal degassing treatment, and a method in which the loading conditions (both voltage and current) on the electrical switch contact are limited to within a range at which defective conduction does not appear.

Accordingly, the present inventors carried out a vigorous investigation with a view to eliminating the above problems, and this invention was achieved as a result. That is, the object of the present invention is to provide a method for preventing the problem of poor conduction caused by organopolysiloxane gas at electrical switch contacts, for example the electrical switch contacts used in relays, switches, micromotors, etc.

Means Solving the Problem and Function Thereof

In methods for preventing the poor conduction at electrical switch contacts which is caused by organopolysiloxane gas, the aforesaid object can be accomplished by a method for preventing said poor conduction at electrical switch contacts which consists of providing that the gas of a nitrogenous base be simultaneously present in said organopolysiloxane gas. When the phrase "preventing poor conduction at electrical switch contacts" is used herein, it means is that the switch will continue to function properly for a large number of cycles and it is not intended to mean that the switch will never fail or develop poor conduction characteristics, but the number of cycles the switch can operate without developing poor conduction will be greater using the method of this invention than when this invention is not used.

SUMMARY OF THE INVENTION

This invention relates to a method for preventing the poor conduction at an electrical switch contact caused by organopolysiloxane gas comprising providing that a nitrogenous base gas be simultaneously present in said organopolysiloxane gas.

DESCRIPTION OF THE PREFERRED EMBODIMENTS

To explain the preceding, the organopolysiloxane gas contemplated by the present invention is the gas of volatile, low molecular weight organopolysiloxanes which is responsible for the problem of poor conduction at electrical switch contacts. This gas is present in silicone products such as silicone oils, silicone rubbers silicone greases, silicone resins, etc. which are used as structural and secondary materials in electrical devices, or is generated by the decomposition of these silicone products Typical examples of organopolysiloxanes which can become such a gas are the cyclic dimethylpolysiloxanes having the general formula $$\{(CH_3)_2SiO\}_n$$

n is an integer having a value of 3 to 10, and linear dimethylpolysiloxanes having the general formula $$CH_3\{(CH_3)_2SiO\}_mSi(CH_3)_3$$

m is an integer having a value of 1 to 10. Their vapor pressures at room temperature are at least 0.0133 Pa(-pascal). Other examples are low molecular weight methylvinylpoly- siloxanes, methylphenylpolysiloxanes, and methyl(3 3 3-trifluoropropyl)polysiloxanes.

With regard to the nitrogenous base whose gas is to be simultaneously present in said organopolysiloxane gas, this is a compound which has a vapor pressure of at least 0.0133 Pa within the temperature range of use of the electrical device, or a compound which generates a nitrogenous base gas by means of decomposition within said temperature range. While the type of compound is not specifically restricted it is best to avoid compounds which corrode electrical switch contact points or which are unduly toxic for humans, except in extraordinary circumstances.

Examples of nitrogenous base gas compounds are aliphatic primary amines such as methylamine, ethylamine, propylamine, isopropylamine, butylamine, amylamine, hexylamine, heptylamine, octylamine, etc.; aliphatic secondary amines such as dimethylamine, diethylamine, dipropylamine, diisopropylamine, dibutylamine, diamylamine, etc.; aliphatic tertiary amines such as trimethylamine, triethylamine, tripropylamine, tributylamine, etc.; aliphatically unsaturated amines such as allylamine, diallylamine, triallylamine, etc.; alicyclic amines such as cyclopropylamine, cyclobutylamine, cyclopentylamine, cyclohexylamine, etc.; aromatic amines such as aniline, methylaniline, benzylamine, etc.; guanidine and its derivatives; aliphatic diamines such as ethylenediamine, trimethylenediamine, tetramethylenediamine, pentamethylenediamine, etc.; aromatic diamines such as ortho-phenylenediamine, meta-phenylenediamine. para-phenylenediamine, etc. triamines such as 1.2.3-triaminopropane, etc.; N-(trimethylsilyl)dimethylamine; N,N-(trimethylsilyl)methylamine; tetramines such as triethylenetetramine, etc.; and benzotriazoles.

In the present invention the preferred ratio between the gases which are simultaneously present is such that the organopolysiloxane gas and the nitrogenous base gas is at least 0.0001 mole of nitrogenous base gas per one mole organopolysiloxane gas.

For electrical devices which use a silicone product as a structural or secondary material and which have electrical switch contacts in a sealed or semi-sealed vessel the present invention is readily implemented by loading or feeding the aforesaid nitrogenous base into said vessel. Various tactics are available as follows with regard to the method of loading: the aforesaid nitrogenous base can be coated as such on the interior of the aforesaid vessel; it can be placed in a small container (laboratory dish box, etc.) and this is then loaded; the aforesaid nitrogenous base can be dissolved or mixed into an organic or inorganic substance and this is then loaded: or the vessel may be equipped with a material consisting of a silicone rubber (other than the aforesaid silicone product) or organic rubber which contains the aforesaid nitrogenous base. Any of these methods maybe used so long as the object of the present invention is not adversely affected.

EXAMPLES

The present invention will be explained in the following using illustrative examples. The electrical switch contacts were subjected to a load switching test as follows.

Load Switching Test of the Electrical Switch Contacts

A microrelay having 8 electrical switch contacts was set in a sealable 1 L container, and a device was set up so these contacts could be opened and closed from the outside. A source of organopolysiloxane gas and a nitrogenous base were both placed inside this container. After sealing the container an electrical switching test was conducted under the following conditions.

Voltage applied to each contact 24 V DC
Load applied to each contact: 1 kohms (R load)
Make/break frequency for each contact: 2 cycles per second
(2 Hz)
Test temperatures: 24° C. and 70° C.

The value of the contact resistance for the contacts was measured by the voltage-drop method and was recorded with a multipen recorder A contact was evaluated as faulty when the value of the contact resistance reached at least 10 ohms. The life to faulty contact was specified by the number of switching cycles for the contact until faulty contact occurred. Considering the eight contacts, the number of switching cycles until the occurrence of the first fault was designated as the first fault life and the number of switching cycles at which fault had occurred in 4 contacts was designated as the 50% fault life.

EXAMPLES 1 to 8

One gram octamethylcyclotetrasiloxane (D4) as the organopolysiloxane and one gram of amine compound as reported in Table 1 as the nitrogenous base were placed in the load switching test container described above, this was then sealed, and the electrical switch contacts were subjected to the load switching test. These test results are reported in Table 1.

For comparison, only one gram D4 was placed in the load switching test container, while the nitrogenous base was omitted. The electrical switch contacts were then subjected to the load switching test, and these results are also reported in Table 1. According to Table 1, the contact fault life was much higher for the presence of a nitrogenous base gas in the organopolysiloxane gas than when the electrical switch contact was in contact with only organopolysiloxane gas.

TABLE 1

| | Components and Fault Lives | | | |
|---|---|---|---|---|
| | | | Contact Fault Life (cycles) | |
| | Organopolysiloxane | Nitrogenous Base (amine) | First Fault | 50% Fault |
| THE PRESENT INVENTION | | | | |
| 1 | octamethylcyclotetrasiloxane (D4) | nonylamine | >300000 | >300000 |
| 2 | octamethylcyclotetrasiloxane (D4) | decylamine | >300000 | >300000 |
| 3 | octamethylcyclotetrasiloxane (D4) | benzylamine | 141750 | >300000 |
| 4 | octamethylcyclotetrasiloxane (D4) | cyclohexylmethylamine | 113850 | 253450 |
| 5 | octamethylcyclotetrasiloxane (D4) | diamylamine | >300000 | >300000 |
| 6 | octamethylcyclotetrasiloxane (D4) | tributylamine | 78450 | 127650 |
| 7 | octamethylcyclotetrasiloxane (D4) | tetraethylethylenediamine | >300000 | >300000 |
| 8 | octamethylcyclotetrasiloxane (D4) | tetramethylbutanediamine | 117150 | 247650 |
| COMPARISON EXAMPLE | | | | |

TABLE 1-continued

| | Components and Fault Lives | | | |
|---|---|---|---|---|
| | | | Contact Fault Life (cycles) | |
| | Organopoly-siloxane | Nitrogenous Base (amine) | First Fault | 50% Fault |
| 1 | octamethylcyclo-tetrasiloxane (D4) | none | 5550 | 9150 |

Note:
The test temperature was 24° C.

EXAMPLE 9

One gram triethylenetetramine in a laboratory dish and 10 g of a room temperature-cured silicone rubber (1 ) containing 0.49 wt.% of $D_4$ to $(CH_3)_2SiO_{10}$ based on and this container was heated to 70° C. The contacts of the microrelay were subjected in this state to the load switching test according to the procedure of Examples 1 to 8.

In the test of Comparison Example 2, only 10 g of room temperature-cured silicone rubber (1) and the microrelay were sealed in the container. This was then heated to 70° C., and the load switching test was carried out by the procedure described for Examples 1 through 8. All results are reported in Table 2. As Table 2 indicates the contact fault life was much higher when triethylenetetramine vapor was simultaneously present than when only the room temperature-cured silicone rubber (1) was loaded (Comparison Example 2).

TABLE 2

| | Components and Fault Lives | | | |
|---|---|---|---|---|
| | | | Contact Fault Life (cycles) | |
| | Silicone Product | Nitrogenous Base | First Fault | 50% Fault |
| EXAMPLE 9 | room temperature-cured silicone rubber (1) | triethylene-tetramine | 61050 | 175150 |
| COMPARISON EXAMPLE 2 | room temperature-cured silicone rubber (1) | none | 18750 | 37050 |

Note:
The test temperature was 70° C.

EXAMPLE 10

Electrical switch contacts were subjected to a load switching test by the procedure described in Example 9, with the exception that benzotriazole was used in place of the amine compound used in Example 9. The first fault life was greater than 50.000, and the 50% fault life was greater than 150,000.

EXAMPLE 11

1.0 Part by weight of tetraethylethylenediamine was kneaded into 100 parts by weight of uncured room temperaturecurable curable silicone rubber paste containing 0.06 wt.% of $D_4$ to $(CH_3)_2SiO_{10}$, and this was then cured at room temperature.

10g of the resulting silicone rubber and 10g of silicone rubber (1) as described in Example 9 were sealed together with a microrelay in a container as in Example 9. The container was then heated to 70°C., and the microrelay contacts were subjected under this condition to a load switching test according to the procedure of Example 9. The results for the contact fault lives were as follows: 51,000 cycles for the first fault life, and 140,000 cycles for the 50% fault life.

Effects of the Invention

With respect to methods for preventing the poor conduction at electrical switch contacts which is caused by organopolysiloxane gas, because the present invention consists of providing that the gas of a nitrogenous base be simultaneously present in said organopolysiloxane gas, it is characteristic of the present invention that the electrical switch contacts do not suffer from poor conduction even when in contact with organopolysiloxane gas. As a consequence, relays, switches. micromotors, etc., when mounted on electrical or electronic devices which are used under sealed or semi-sealed conditions, will not suffer from the problem of poor conduction, and device reliability is accordingly increased.

That which is claimed is:

1. A method for preventing the poor conduction at an electrical switch contact caused by organopolysiloxane gas comprising loading a nitrogenous base into a sealed or semi-sealed vessel containing an electrical device with an electrical switch contact and operating the electrical device at a temperature which produces the organopolysiloxane gas, where the nitrogenous base provides a nitrogenous base gas simultaneously present in said organopolysiloxane gas, said nitrogenous base is an amine.

2. The method according to claim 1 in which the amine is an aliphatic amine.

3. The method according to claim 1 in which the the amine is an aromatic amine.

4. The method according to claim 2 in which the aliphatic amine is selected from the group consisting of nonylamine, decylamine, cyclohexylmethylamine, diamylamine, tributylamine, tetraethylethylenediamine, tetramethylbutanediamine, and triethylenetetraamine.

5. The method according to claim 3 in which the aromatic amine is selected from the group consisting of benzylamine and benzotriazole.

6. The method according to claim 1 in which the nitrogenous base gas is simultaneously present in the organopolysiloxane gas in an amount such that there is at least 0.0001 mole of the nitrogenous base gas per one mole of the organopolysiloxane.

7. The method according to claim 2 in which the nitrogenous base gas is simultaneously present in the organopolysiloxane gas in an amount such that there is at least 0.0001 mole of the nitrogenous base gas per one mole of the organopolysiloxane.

8. The method according to claim 1 in which the nitrogenous base gas is a compound which has a vapor pressure of at least 0.0133 pascal within the temperature range of the use of an electrical device having an electrical switch contact or is a compound which generates a nitrogenous base gas by means of decomposition within the temperature range of the use of an electrical device having an electrical switch contact.

* * * * *